US005868306A

United States Patent [19]

Wen-Tsan

[11] Patent Number: 5,868,306

[45] Date of Patent: Feb. 9, 1999

[54] DETACHABLE STORAGE BOX

[76] Inventor: Wang Wen-Tsan, P.O. Box 82-144, Taipei, Taiwan

[21] Appl. No.: 764,294

[22] Filed: Dec. 12, 1996

[51] Int. Cl.[6] ..... B65D 25/04

[52] U.S. Cl. ..... 229/120.07; 206/278; 229/120.22; 229/120.31

[58] Field of Search ..... 206/278, 292; 229/120.07, 120.22, 120.31, 120.33, 120.37, 198, 198.1, 198.2, 198.3

[56] References Cited

U.S. PATENT DOCUMENTS

| | | | |
|---|---|---|---|
| 1,140,741 | 5/1915 | Grunow, Jr. | 229/120.22 |
| 3,101,652 | 8/1963 | Imielinski | 229/120.31 |
| 3,189,074 | 6/1965 | Schaefer | 229/120.22 |
| 3,217,771 | 11/1965 | Skirow et al. | 229/120.22 |
| 3,306,513 | 2/1967 | Fishman | 229/120.31 |
| 4,094,454 | 6/1978 | Snyder | 229/120.33 |
| 4,948,039 | 8/1990 | Amatangelo | 229/198 |
| 4,979,657 | 12/1990 | Espiritu | 229/198 |

*Primary Examiner*—Jimmy G. Foster
*Attorney, Agent, or Firm*—A & J

[57] ABSTRACT

A detachable storage box including a box body formed by folding up a sheet element and securing it into shape by hook and loop materials and having male fastening elements, and a collapsible lattice type partition device mounted inside the box body and defining a plurality of separated open spaces for keeping small items and having female fastening elements respectively fastened to the male fastening elements of the box body.

1 Claim, 3 Drawing Sheets

DETACHABLE STORAGE BOX

BACKGROUND OF THE INVENTION

The present invention relates to storage boxes for keeping personal small items, and more particularly to a detachable storage box which is comprised of a collapsible box body, and a collapsible lattice type partition device fastened to the inside of the box body.

A variety of cabinets and storage boxes have been disclosed for keeping clothes, and any of a variety of small personal items. These storage devices are commonly not collapsible, therefore they occupy much room spaces when not in use. Furthermore, when small personal items are stored in a cabinet or storage box, it is difficult to classify the storage items.

SUMMARY OF THE INVENTION

It is one object of the present invention to provide a storage box which is detachable. It is another object of the present invention to provide a storage box which can be quickly set up when in use, and conveniently collapsed when not in use. According to one aspect of the present invention, the detachable storage box is comprised of a box body formed by folding up a sheet element, which is comprised of a bottom panel, a front panel, a back panel, a top panel and two side panels, and securing it into shape by hook and loop materials and having male fastening elements, and a collapsible lattice type partition device mounted inside the box body and defining a plurality of separated open spaces for keeping small items and having female fastening elements respectively fastened to the male fastening elements of the box body. According to another aspect of the present invention, an index window is formed at the front panel of the box body on the outside for holding an index card. According to still another aspect of the present invention, a loop is fastened to the back side of the bottom panel for hanging.

DETAILED DESCRIPTION OF THE PREFERRED EMBODIMENT

Figure 1:
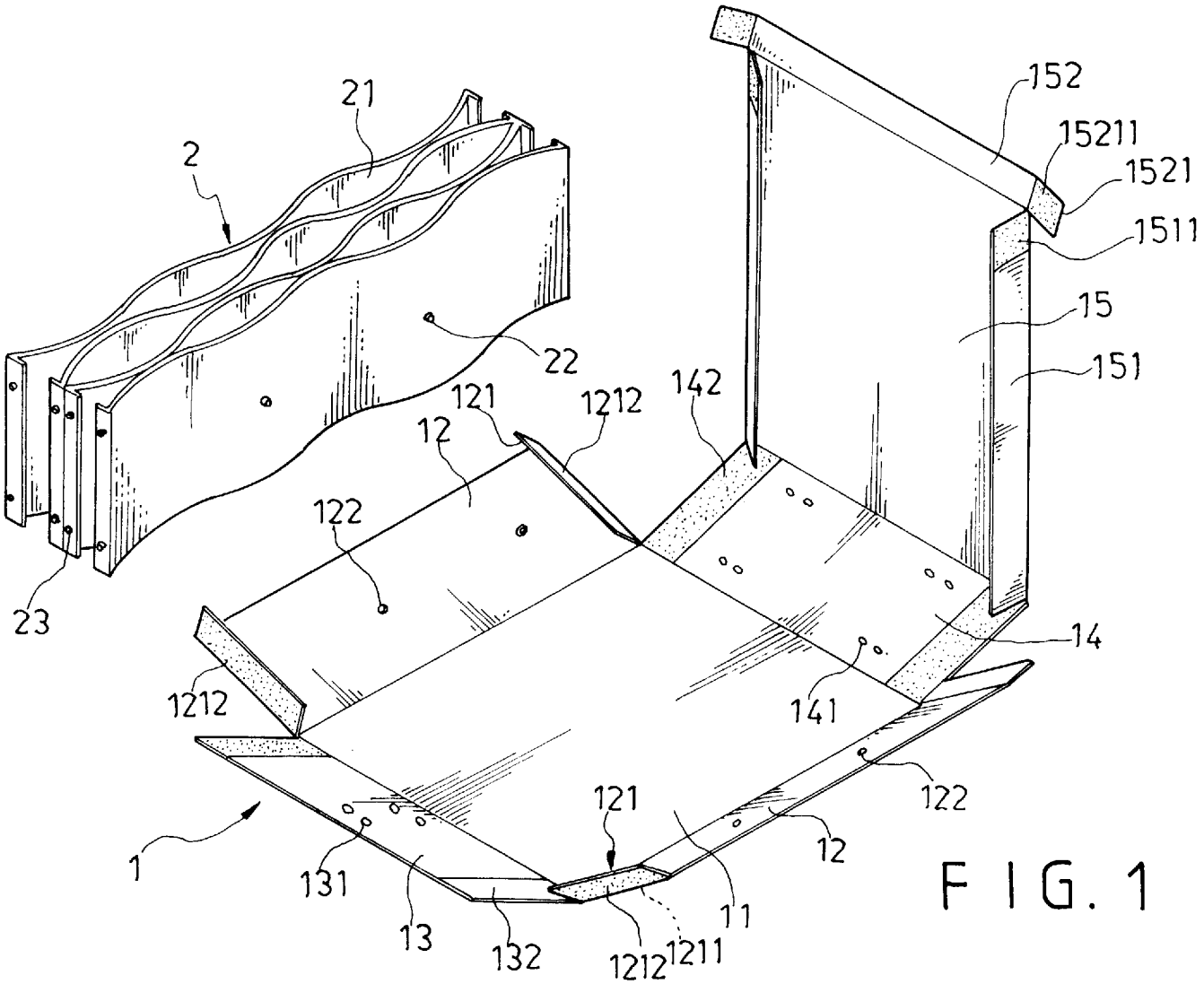
FIG. 1 shows the box body extended out, and the collapsible lattice type partition device detached from the box body according to the present invention.

Referring to FIG. 1, a detachable storage box in accordance with the present invention is generally comprised of a box body 1, and a collapsible lattice type partition device 2.

Figure 2:
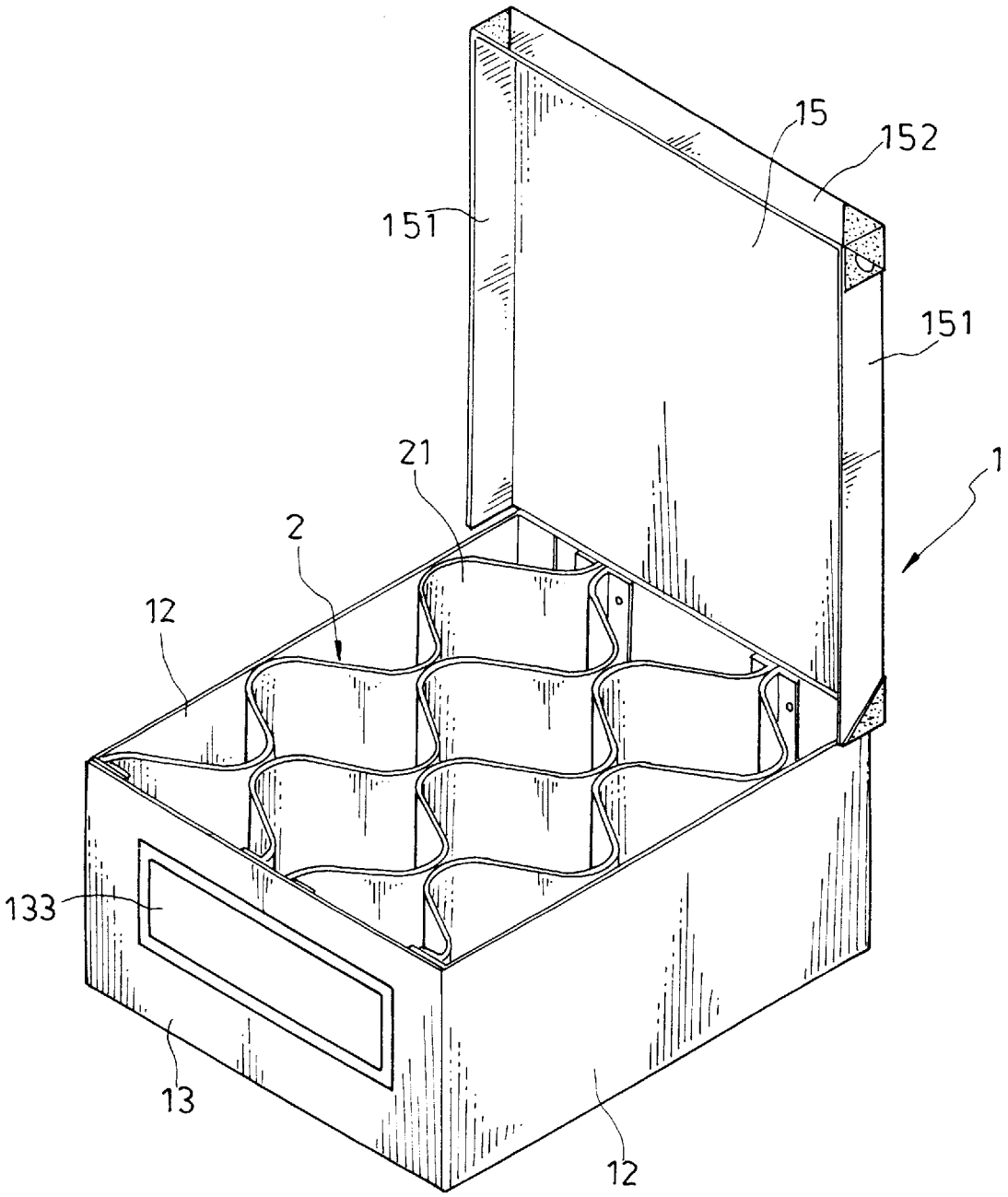
FIG. 2 shows the box body set into shape, the collapsible lattice type partition device extended out and fixed to the inside of the box body according to the present invention.
Figure 3:
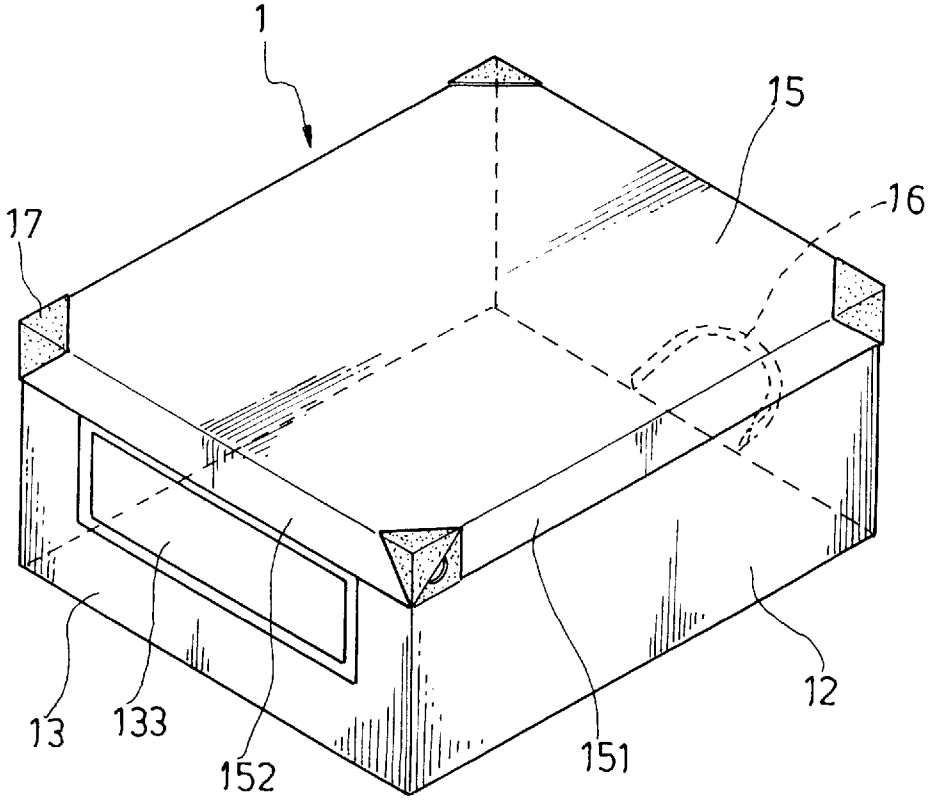
FIG. 3 is a perspective of the box body when closed according to the present invention.

Referring to FIGS. 2 and 3, and FIG. 1 again, the box body 1 is made by folding up a sheet element into shape, comprising a rectangular bottom panel 11 having a front side and a rear side and two opposite lateral sides, a front panel 13 and a back panel 14 respectively extended from the front and rear sides of the rectangular bottom panel 11, two side panels 12 respectively extended from the two opposite lateral sides of the bottom panel 11, and a top panel 15 extended from one side of the back panel 14 remote from the bottom panel 11. The front panel 13 and back panel 14 have respective hook tapes 132, 142 bilaterally disposed at an inner side, and respective female fastening elements (socket sides of snaps) 131, 141 disposed at an inner side between the male fastening elements 132, 142. The front panel 13 has an index window 133 at an outer side for holding an index card (see FIG. 3). Each side panel 12 comprises two opposite side flaps 121, and a plurality of female fastening elements (socket sides of snaps) 122 at an inner side between the side flaps 121. Each side flap 121 has a plurality of female fastening elements (socket sides of snaps) 1211 at an inner side, and a loop tape 1212 at an outer side. The top panel 15 comprises two side flaps 151 at two opposite lateral sides thereof, and a front flap 152 at a front side thereof remote from the back panel 14. Each side flap 151 has a loop tape 1511 at an outer side at one end adjacent to the front flap 152. The front flap 152 comprises two end flap sections 1521, and two hook tapes 15211 respectively disposed at the end flap sections 1521 at an inner side. The top panel 15 further comprises four corner protection elements 17 respectively disposed at the four corners thereof at an outer side (see FIG. 2).

Referring to FIG. 1 again, the collapsible lattice type partition device 2 is comprised of a plurality of a plurality of sheet elements 21 in parallel into a lattice structure. Each sheet element 21 has a plurality of male fastening elements (ball sides of snaps) at two opposite ends. The two outer sheet elements 21 of the collapsible lattice type partition device 2 have respective male fastening elements (ball sides of snaps) 22 at an outer side. The sheet elements 21 of the collapsible lattice type partition device 2 can be made from plastic (for example, polyvinyl chloride), fabric, etc., and fastened to one another by high-frequency heat sealing, glue, or stitches.

Referring to Figures from 1 to 3 again, the side panels 12 are inwardly folded up, then the side flaps 121 of each side panel 12 are respectively and inwardly folded up, and then the front panel 13 and the back panel 14 are inwardly folded up, and then the hook tapes 132 of the front panel 13 and the hook tapes 142 of the back panel 14 are respectively fastened to the loop tapes 1212 of the side flaps 121 of the side panels 12, and then the side flaps 151 and front flap 152 of the top panel 15 are respectively and inwardly folded up, and then the end flap sections 1521 are inwardly folded up, and then the hook tapes 15211 are respectively fastened to the loop tapes 1511. When the hook tapes 15211 and the loop tapes 1511 are respectively fastened together, the top panel 15, the side flaps 151 and the front flap 152 form a cover. When the box body 1 is set up, the collapsible lattice type partition device 2 is put into the inside of the box body 1 and extended out, and then secured to the inside of the box body 1 by fastening the respective male fastening elements (ball sides) 22, 23 of the collapsible lattice type partition device 2 to the respective female fastening elements (socket sides) 122, 131, 141 of the side panels 12, front panel 13 and back panel 14 of the box body 1. When the collapsible lattice type partition device 2 is installed in the box body 1, it defines a plurality of separated open spaces within the box body 1 for keeping small items.

Referring to FIG. 3 again, a hanging loop 16 is fixedly connected to the back side of the bottom panel 11 for hanging.

What the invention claimed is:

1. A detachable storage box comprising:

a box body, said box body comprising a rectangular bottom panel having a front side and a rear side and two opposite lateral sides, a front panel and a back panel respectively extended from the front and rear sides of said rectangular bottom panel, two side panels respectively extended from the two opposite lateral sides of said bottom panel, and a top panel extended from one side of said back panel remote from said bottom panel, said front panel and back panel having respective hook tapes bilaterally disposed at an inner side, and respective female fastening elements disposed at an inner side, said front panel having an index window at an outer side for holding an index card, each of said side panel comprising two opposite side flaps, and a plurality of female fastening elements at an inner side between, the side flaps of said side panels having a plurality of female fastening elements at an inner side, and a respective loop tape at an outer side respectively fastened to the hook tapes of said front panel and said back panel, said top panel comprising two side flaps at two opposite lateral sides thereof, and a front flap at a front side thereof remote from said back panel, the side flaps of said top panel having a respective loop tape at an outer side at one end adjacent to said front flap, said front flap comprising two end flap sections, and two hook tapes disposed at said end flap sections at an inner side and respectively fastened to the loop tapes of the side flaps of said top panel; and a collapsible lattice type partition device mounted inside said box body and defining a plurality of open spaces for keeping small items, said collapsible lattice type partition device being comprised of a plurality of sheet elements connected in parallel into a lattice structure, said sheet elements having a plurality of male fastening elements respectively fastened to the female fastening elements of said side panels and said front panel and said back panel.

* * * * *